US006666618B1

(12) United States Patent
Anaya et al.

(10) Patent No.: US 6,666,618 B1
(45) Date of Patent: Dec. 23, 2003

(54) SYSTEM AND METHOD FOR SEALING ROADWAY JOINTS

(76) Inventors: Richard James Anaya, P.O. Box 758, Sabana Seca, PR (US) 00952; James Beaubien, P.O. Box 758, Sabana Seca, PR (US) 00952

( * ) Notice: Subject to any disclaimer, the term of this patent is extended or adjusted under 35 U.S.C. 154(b) by 0 days.

(21) Appl. No.: 10/304,075

(22) Filed: Nov. 25, 2002

(51) Int. Cl.[7] ..... E01C 11/02; E01C 11/06

(52) U.S. Cl. ..... 404/68; 404/69; 404/74; 14/73.1

(58) Field of Search ..... 14/73.1; 404/47, 404/48, 56, 67, 68, 69, 72, 75, 74

(56) References Cited

U.S. PATENT DOCUMENTS

| | | | | | |
|---|---|---|---|---|---|
| 3,394,639 | A | * | 7/1968 | Viehmann | 404/47 |
| 3,447,430 | A | * | 6/1969 | Gausepohl | 404/69 |
| 3,659,390 | A | * | 5/1972 | Balzer et al. | 52/464 |
| 3,951,562 | A | | 4/1976 | Fyfe | |
| 4,129,967 | A | * | 12/1978 | Barlow | 52/15 |
| 4,245,925 | A | | 1/1981 | Pyle | |
| 4,271,650 | A | * | 6/1981 | Lynn-Jones | 52/395 |
| 4,305,680 | A | | 12/1981 | Rauchfuss, Jr. | |
| 4,367,976 | A | | 1/1983 | Bowman | |
| 4,374,442 | A | | 2/1983 | Hein et al. | |
| 4,447,172 | A | | 5/1984 | Galbreath | |
| 4,824,283 | A | | 4/1989 | Belangie | |
| 4,927,291 | A | | 5/1990 | Belangie | |
| 4,942,710 | A | * | 7/1990 | Rumsey | 52/396.01 |
| 5,007,765 | A | | 4/1991 | Dietlein et al. | |
| 5,026,609 | A | | 6/1991 | Jacob et al. | |
| 5,071,282 | A | | 12/1991 | Brown | |
| 5,168,683 | A | | 12/1992 | Sansom et al. | |
| 5,190,395 | A | | 3/1993 | Cathey et al. | |
| 5,607,253 | A | | 3/1997 | Almström | |
| 5,649,784 | A | | 7/1997 | Ricaud et al. | |
| 5,664,906 | A | | 9/1997 | Baker et al. | |
| 5,935,695 | A | | 8/1999 | Baerveldt | |
| 6,039,503 | A | | 3/2000 | Cathey | |

* cited by examiner

*Primary Examiner*—Gary S. Hartmann
(74) *Attorney, Agent, or Firm*—Shapiro & Dupont LLP

(57) ABSTRACT

A system for sealing joints in roadways wherein nose plates are attached to each side of the joint to form a gap between the nose plates. A lower seal element is located in the gap between the nose plates. A vapor barrier is provided that extends between the top portions of the two nose plates. The vapor barrier includes edges that are attached to the tops of the nose plates utilizing anchor caps. An upper seal may be included that is located on top of the lower seal element. The upper seal is formed by applying a liquid sealant over the lower seal element and vapor barrier or by installing a preformed gasket that is anchored to the nose plates using the anchor caps.

23 Claims, 4 Drawing Sheets

SYSTEM AND METHOD FOR SEALING ROADWAY JOINTS

BACKGROUND OF THE INVENTION

1. Field of the Invention

The present invention relates generally to systems and methods for sealing joints in large structures such as roadways. More particularly, the present invention is directed to providing seals in roadway joints that are resistant to water penetration over relatively long periods of time.

2. Description of Related Art

Roadways come in many different sizes and shapes. Roadways may be located directly on land or they can take the form of bridges that extend over water or other non-aqueous features. Roadways are typically made from a wide variety of materials including asphalt, concrete and metal. In many situations it is necessary to form a lateral gap or joint in the roadway to allow for independent movement of the adjacent roadway sections. Such movement is caused by many factors including expansion and contraction of the adjacent roadway sections due to changes in temperature. Roadway gaps or joints are especially critical in elevated structures such as bridges and parking garages. Relative movement of the roadway sections tends to be greater for elevated structures than for roadways located on land. In addition, temperature induced expansion and contraction is more of a problem for elevated structures because temperature fluctuations tend to be more rapid and of a greater magnitude than for roadways located on land.

A multitude of seal systems and configurations have been used to seal roadway joints. Seal systems vary depending upon the roadway type and the size of the joint being sealed. One popular technique involves pressing a flexible rod or tube into the joint. The remainder of the joint above the tube is then filled in with a sealant of some type. The rods or tubes are typically made from some type of foam material and are commonly referred to as "backer rods". Other types of seal systems utilize flexible gaskets and combinations of gaskets with sealants and structural reinforcements to provide sealing of the roadway joint. Examples of a variety of sealing systems that have been proposed for sealing joints in roadways are set forth in the following U.S. Pat. Nos.: 3,951,562; 4,245,925; 4,305,680; 4,367,976; 4,374,442; 4,447,172; 4,824,283; 4,927,291; 5,007,765; 5,026,609; 5,071,282; 5,168,683; 5,190,395; 5,607,253; 5,649,784; 5,664,906; 5,935,695; and 6,039,503.

The goal of any roadway joint seal system is to prevent water and other contaminants from entering the joint and to provide a durable surface over which vehicular traffic can pass. It is important that the seal be effective over relatively long periods of time and that it function properly even when exposed to extreme weather conditions. A major problem with many roadway joint seals is that they start to leak after relatively short periods of time. This is a particular problem in high moisture environments where the seal is exposed to water on a continual basis. Water entering the joint can cause relatively rapid deterioration of the roadway surrounding the joint. This is especially a problem in steel reinforced roadways where corrosion of the steel reinforcing material can seriously weaken the joint.

There presently are many types of seal systems that provide adequate sealing of roadway joints. Even so, there still is a continuing need to provide new sealing systems that are effective in protecting roadway joints over relatively long periods of time. Such sealing systems should be suitable for use in sealing new roadway joints. They also should be suitable for use in replacing existing seals in roadway joints that have deteriorated or otherwise failed.

SUMMARY OF THE INVENTION

In accordance with the present invention, systems and methods are provided for sealing roadway joints. The term "roadway joints" as used herein is intended to encompass all types of joints present in any structure that is intended to accommodate vehicular traffic. Roadway joints include all types of joints, including expansion joints that are present in concrete and asphalt highways located directly on land as well as elevated structures, such as bridges, parking garages, highway overpasses and the like.

The sealing system in accordance with the present invention is designed to seal joints in the roadway wherein the joint has a first wall and a second wall that define a space between the walls. The system includes a first nose plate that is attached to the first wall of the joint to be sealed. A second nose plate is attached to the second wall of the joint. Once attached, the first and second nose plates define a gap between the two interior walls of the nose plates. A lower seal element is located in the gap between the interior walls of the nose plates. A vapor barrier is provided that extends between the top portions of the two nose plates. The vapor barrier includes a first edge portion that is attached to the top of the first nose plate, and a second edge portion that is attached to the top of the second nose plate. Two anchor caps are provided which are used to anchor the edge portions of the vapor barrier to the tops of the nose plates. The combination of vapor barrier and anchoring caps provides a water-tight seal which is especially effective in preventing moisture from entering the joint over relatively long periods of time.

The sealing system in accordance with the present invention as described above may further include an upper seal that is located above the lower seal element and extends between the top portions of the two nose plates. Depending upon the size of the gap between the two nose plates, the upper seal may be formed from a curable liquid sealant or a preformed gasket.

The present invention also includes methods for sealing joints in roadways. The methods involve attaching nose plates to opposing sides of the joint such that the interior walls of the installed nose plates define a gap between the two plates. A lower seal element is then installed in the gap between the two nose plates. The vapor barrier is then installed and anchored to the top of the nose plates utilizing anchoring caps that are designed to clamp the vapor barrier to the nose plates. The method may further include the step of installing an upper seal located above the lower seal element wherein the upper seal extends between the top portions of the nose plates. Again, depending upon the size of the gap, the upper seal may be formed by applying a sufficient amount of a sealant to the gap to provide a sealant body that extends between the anchor caps located on the nose plates or the upper seal can be a preformed gasket that is installed into the gap and anchored to the nose plates using the anchor caps.

The above described system and method for sealing roadway joints may be used in new construction or to replace existing seals that have deteriorated or otherwise failed. The present invention is especially useful in sealing joints in elevated roadways such as bridges, parking garages and overpasses. The system is useful in high moisture environments, such as the tropics, where it is important to maintain a watertight seal.

The above described and many other features and attendant advantages of the present invention will become better understood by reference to the following detailed description when taken in conjunction with the accompanying drawings.

DETAILED DESCRIPTION OF THE INVENTION

Figure 1:
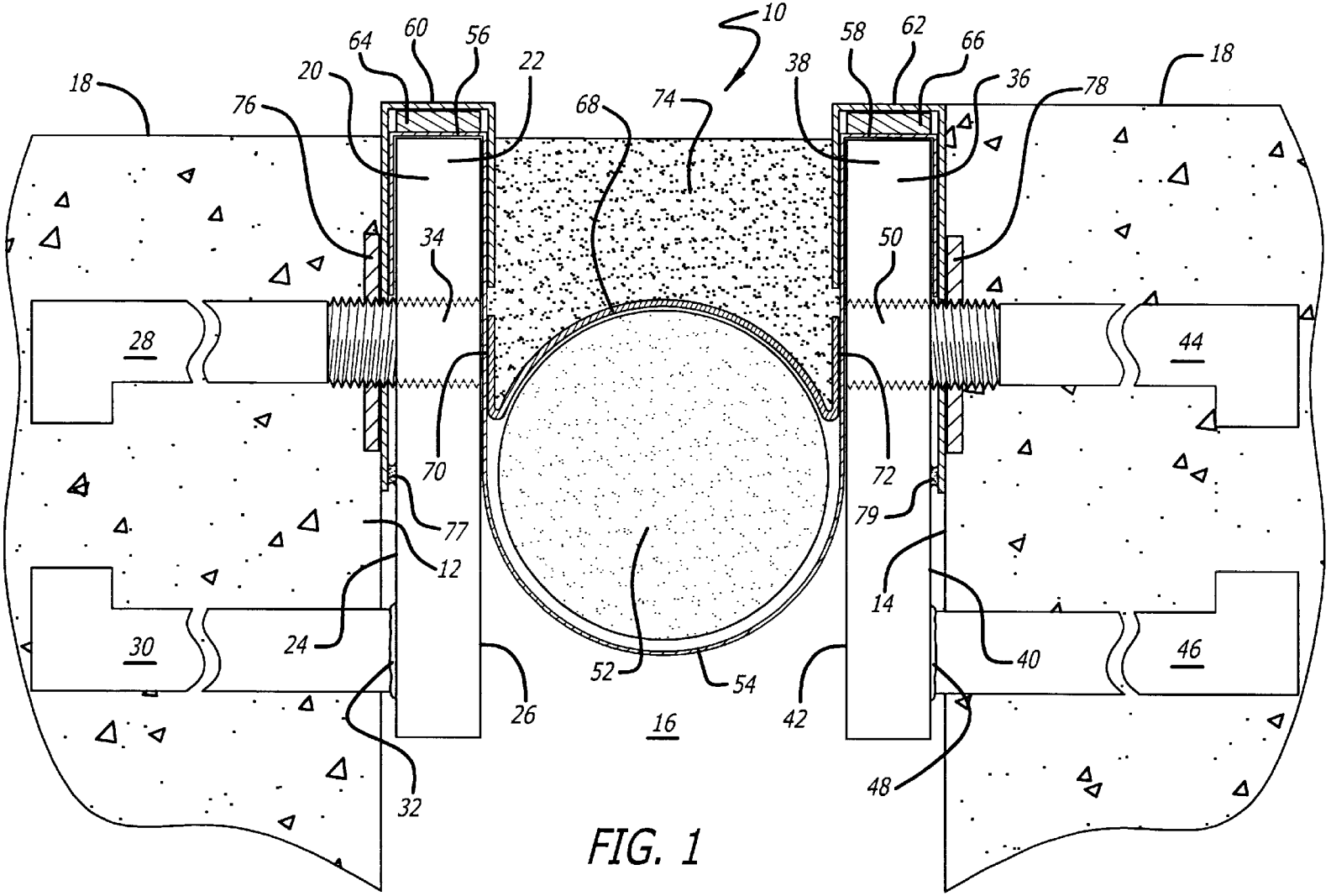
FIG. 1 is a side view a first preferred exemplary system for sealing a joint in a roadway in accordance with the present invention. The system is preferably used for sealing joints that are three inches or less in width.

The present invention involves systems and methods for sealing roadway joints. As previously mentioned, the present invention is applicable to all types of roadway joints that require sealing. A preferred exemplary sealing system in accordance with the present invention is shown generally at 10 in FIG. 1. The joint to be sealed includes a first wall 12 and a second wall 14 that define a space 16 between the first and second walls 12 and 14 that require sealing. The joint is located in roadway 18. The roadway is preferably composed of concrete that is reinforced with steel. However, the roadway may be made from any of the other common roadway materials including asphalt.

The sealing system 10 includes a first nose plate 20 that includes a top portion 22, an exterior wall 24, and an interior wall 26. The first nose plate 20 is preferably attached to the joint wall 12 by way of anchoring bolts 28 and 30. The lower anchoring bolt 30 is securely embedded in the roadway 18 and is attached to the first nose plate 20 by welding as shown at 32. Other connection types are possible including threaded engagement. The top anchor bolt 28 is also securely embedded within the roadway 18 and anchored to the first top plate 20 by a threaded engagement as represented in phantom at 34.

The sealing system further includes a second nose plate 36 that also includes a top portion 38, an exterior wall 40, and an interior wall 42. The second nose plate 36 is also attached to the roadway 18 utilizing anchor bolts 44 and 46. The lower anchor bolt 46 is embedded securely in roadway 18 and connected to the exterior wall 40 of the second nose plate 36 by way of weld 48. The top anchor bolt 44 is attached to the second nose plate 36 by way of a threaded engagement as shown in phantom at 50. The two nose plates 20 and 36 are preferably made from corrosion resistant steel and/or the surfaces are treated to provide protection against corrosion. The nose plates 20 and 36 are preferably about ½ inch thick. However, thicker or thinner nose plates may be used depending upon the size of the joint being sealed. The vertical width of the nose plates 20 and 36 is preferably from 1 inch to 3 inches and may be varied depending again upon the size of the joint to be sealed. The nose plates 20 and 36 are preferably supplied in 10-foot lengths for easy handling and installation while at the same time limiting the number of lateral joints that are required in the roadway seal. Of course, shorter or longer nose plates may be used.

A lower seal element 52 is located in the gap between the interior walls 26 and 42 of the nose plates. The lower seal element 52 is preferably in the form of a backer rod. Backer rods are well known and commonly used in sealing roadway joints. Backer rods are typically made from open or closed cell foam and are well known in the art. Any of the known backer rod types may be used to form the lower seal element 52. Open cell foam backer rods are preferred.

The seal element 10 further includes a vapor barrier 54 that extends up and over the first nose plate 20 as shown at 56. The vapor barrier 54 also extends up and over the second nose plate 36 as shown at 58. A first anchor cap 60 is provided for clamping the edge portion of the vapor barrier 54 to the top portion of the nose plate 22. A second anchor cap 62 is provided for clamping the second edge portion of the vapor barrier 54 to the top portion 38 of the second nose plate 36. The anchor caps 60 and 62 are preferably made from steel or other structurally strong material, such as high strength plastic. Composite materials that are made from fabric that is embedded in a resin matrix may also be used. Such composites include fiberglass and resin impregnated carbon fiber. Gaskets 64 and 66 are placed under the anchor caps 60 and 62, respectively, in order to provide a cushion between the anchor caps, nose plates and the vapor barrier 54. The gasket is preferably made from a flexible elastomer such as rubber.

The vapor barrier 54 may be made from any suitable material that is moisture impermeable. Suitable vapor barrier materials include rubber, plastics, and woven fabrics impregnated with rubber or plastic materials. A vapor barrier is preferably from 0.001 inch to 0.100 inch thick. Preferred vapor barrier materials are made from rubber or thermoplastic polymers that may be heat welded to other materials.

The seal system 10 also includes an upper membrane 68 that is thermally welded or glued to vapor barrier 54 at locations 70 and 72. The upper membrane is preferably made from the same types of materials that are used to form the vapor barrier 54. The upper membrane 68 is optional, but is preferred. The space on top of upper membrane 68 is preferably sealed with an upper seal 74. The upper seal 74 is formed by filling the gap on top of upper membrane 68 with a suitable sealant. Any number of the well-known sealants typically used in sealing roadway joints may be utilized. The sealants are typically liquid during application and cure to form a final seal element 74. Exemplary sealants that are commercially available include Dow 902 which is available from Dow Corning (Midland, Mich.) and THC 9000 which is available from Tremco (Beachwood, Ohio).

The anchor caps 60 and 62 preferably fit relatively tightly over the nose plates 20 and 36, vapor barrier 54 and gaskets 64 and 66. It is preferred that the anchor caps 60 and 62 be held in place utilizing washers 76 and 78, respectively. The washers 76 and 78 are threaded on anchor bolts 28 and 44, respectively, so that they may be tightened down against the outer side of the anchoring caps to hold them firmly in place. The lower portion of the anchor caps may be welded to the nose plates as shown at 77 and 79 to provide further attachment of the anchor caps to the nose plates. The welds 77 and 79 may be continuous along the length of the nose plates or they may be spot welds.

In FIG. 1, the seal system 10 is shown from the side. The length of the backer rod 52, nose plates 20 and 36 will vary depending upon the length of the joint to be sealed. As previously mentioned, the nose plates are preferably provided in 10-foot lengths. For roadway joints longer than 10 feet, multiple lengths are required. The backer rods, membranes and gaskets may also be provided in matching 10-foot lengths. At the junction of each length, the nose plates are welded together and the backer rod, membrane and gaskets are either thermally welded or glued together using splices. The backer rod, membrane and gaskets may be provided in longer lengths to reduce the number of joints that are required. The upper seal element 74 is formed last by application of the liquid sealant to the entire length of the joint. The sealing system 10 is preferably used for sealing joints in bridges, parking garages and other elevated roadways wherein the distance between the first and second joint walls 12 and 14 is three inches or less.

Figure 2:
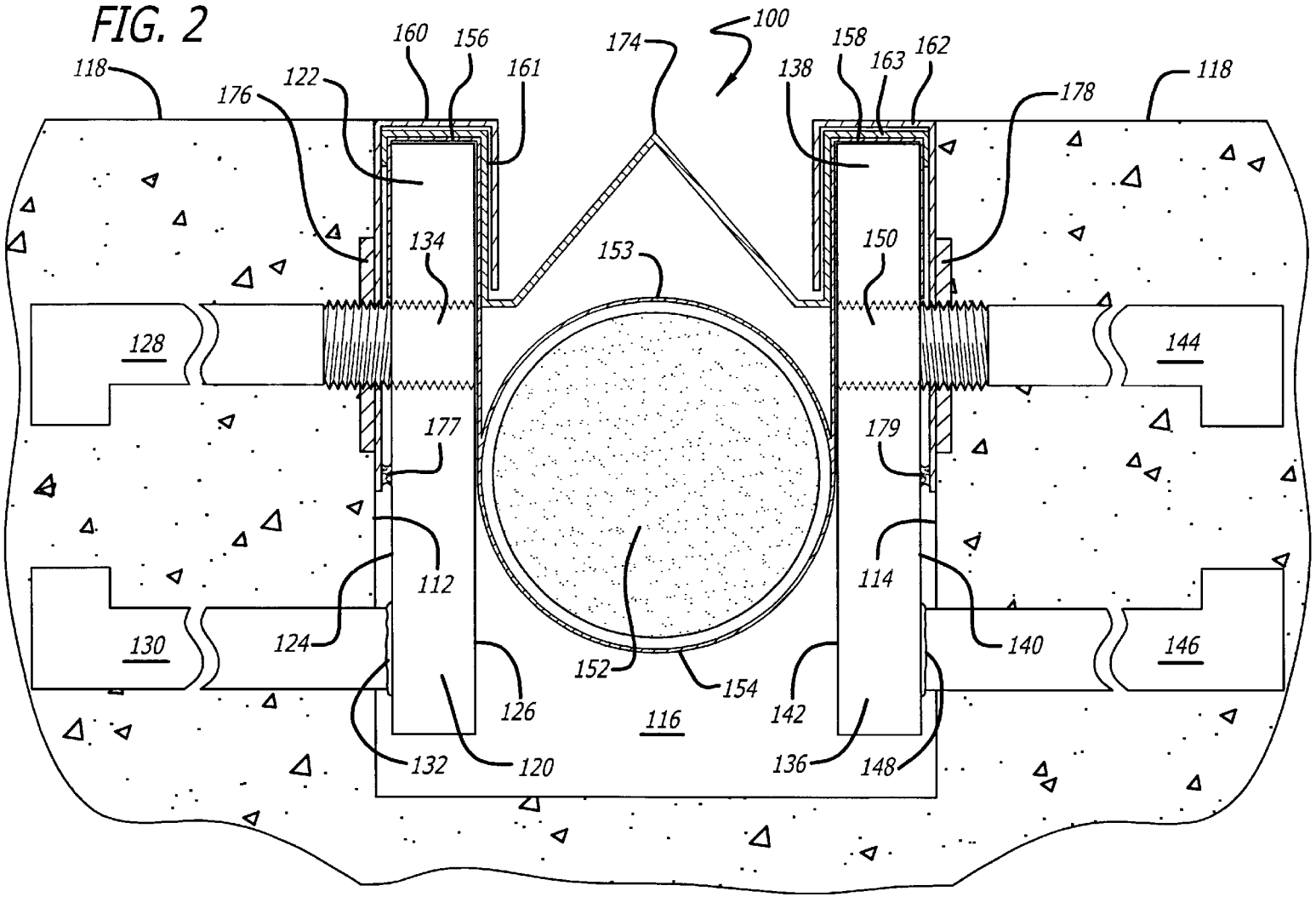
FIG. 2 is a side view of a second preferred exemplary system for sealing a joint in a roadway in accordance with the present invention. This preferred system is designed for use in sealing roadway joints that are equal to or larger than three inches.

A second preferred exemplary seal system in accordance with the present invention is shown at 100 in FIG. 2. The seal 100 is designed for use in sealing joints that are three inches or wider. The sealing system 100 is basically the same as sealing system 10 except that the liquid curable seal 74 in FIG. 1 is replaced with a preformed gasket 174. Referring to FIG. 2, the joint to be sealed includes a first wall 112 and a second wall 114 that define a space 116 between the first and second walls 112 and 114 that require sealing. The joint is located in roadway 118. The roadway is preferably composed of concrete that is reinforced with steel. However, the roadway may be made from any of the other common roadway materials including asphalt.

The sealing system 100 includes a first nose plate 120 that includes a top portion 122, an exterior wall 124, and an interior wall 126. The first nose plate 120 is preferably attached to the joint wall 112 by way of anchoring bolts 128 and 130. The lower anchoring bolt 130 is securely embedded in the roadway 118 and is attached to the first nose plate 120 by welding as shown at 132. Other connection types are possible including threaded engagement. The top anchor bolt 128 is also securely embedded within the roadway 118 and anchored to the first top plate 120 by a threaded engagement as represented in phantom at 134.

The sealing system 100 further includes a second nose plate 136 that also includes a top portion 138, an exterior wall 140, and an interior wall 142. The second nose plate 136 is also attached to the roadway 118 utilizing anchor bolts 144 and 146. The lower anchor bolt 146 is embedded securely in roadway 118 and connected to the exterior wall 140 of the second nose plate 136 by way of weld 148. The top anchor bolt 144 is attached to the second nose plate 136 by way of a threaded engagement as shown in phantom at 150. The two nose plates 120 and 136 are preferably made from corrosion resistant steel and/or the surfaces are treated to provide protection against corrosion. The nose plates 120 and 136 are preferably about ½ inch thick. However, thicker or thinner nose plates may be used depending upon the size of the joint being sealed. The vertical width of the nose plates 120 and 136 is preferably from 1 inch to 3 inches and may be varied depending again upon the size of the joint to be sealed. The nose plates 120 and 136 are preferably supplied in 10-foot lengths for easy handling and installation while at the same time limiting the number of lateral joints that are required in the roadway seal. Of course, shorter or longer nose plates may be used.

A lower seal element 152 is located in the gap between the interior walls 126 and 142 of the nose plates. The lower seal element 152 is preferably a backer rod of the same type as backer rod 52 that has been previously described.

The seal element 100 further includes a vapor barrier 154 that extends up and over the first nose plate 120 as shown at 156. The vapor barrier 154 also extends up and over the second nose plate 136 as shown at 158. It is preferred that the vapor barrier 154 is wrapped completely around the backer rod 152 as shown at 153 and thermally or chemically welded together. Optionally, the vapor barrier may be placed under the backer rod and attached to the nose plates to form a moisture impermeable trough in which the backer rod sits.

A first anchor cap 160 is provided for clamping the edge portion of the vapor barrier 154 to the top portion of the nose plate 122. A second anchor cap 162 is provided for clamping the second edge portion of the vapor barrier 154 to the top portion 138 of the second nose plate 136. The anchor caps 160 and 162 are preferably made from the same materials as the previously described anchor caps.

A preformed gasket 174 is used in place of a liquid sealant to provide sealing of the gap above the backer rod 152. The gasket 174 is shaped so that it can be clamped under the anchor caps 160 and 162 as shown at 161 and 163, respectively. The gasket 174 may be made from any of the known gasket materials that are designed for use in exterior applications. These gasket materials include various types of rubbers and synthetic polymers that are compounded with various additives commonly used to control the gasket properties and increase the resistance of the material to weathering. Such additives include UV absorbers, plasticizers and fillers that are used to control the stiffness and flexibility of the material.

The anchor caps 160 and 162 preferably fit relatively tightly over the nose plates 120 and 136, vapor barrier 154 and gasket 174. As was the case in the previously described embodiment, it is preferred that the anchor caps 160 and 162 be held in place utilizing washers 176 and 178, respectively. The washers 176 and 178 are threaded on anchor bolts 128 and 130, respectively, so that they may be tightened down against the outer side of the anchoring caps to hold them firmly in place. A threaded nut and standard non-threaded washer may be used instead of a threaded washer, if desired. The lower portion of the anchor caps may be welded to the nose plates as shown at 177 and 179 to provide further attachment of the anchor caps to the nose plates. The welds 177 and 179 may be continuous along the length of the nose plates or they may be spot welds.

The two exemplary sealing systems described above may be used to seal joints in a wide variety of roadways. However, these sealing systems are especially well suited for sealing joints in elevated roadway structures, such as bridges, overpasses and multi-story garages. In addition, the sealing systems are preferably intended for use in locations where the roadway joint is subjected to relatively constant exposure to rain and other forms of moisture.

The method for installing the sealing systems involves installing the nose plates to either side of the roadway joint using the anchor bolts. The anchor bolts are spaced a sufficient distance apart to provide adequate anchoring of the nose plates. The anchor bolt spacing may be varied depending upon the type of roadway material being sealed. The nose plates and anchors are preferably first put in place and then concrete or asphalt is added to form a tight seal against the outside of the nose plates. A suitable sealant or bonding agent is preferably applied to the exterior walls of nose plates to ensure a watertight seal between the nose plates and the surrounding roadway. Once the nose plates are in position, the backer rod and membrane are installed. For sealing systems of the type shown in FIG. 1, the optional upper membrane 153 is welded in place. Then, the anchor caps and cushioning gaskets are installed followed by application of the liquid sealant to seal the gap above the backer rod. For sealing systems of the type shown in FIG. 2, the membrane may be wrapped completely around the backer rod and welded together or simply passed under it to form a trough in which the backer rod sits. Either way, the membrane and the pre-molded gasket are attached to the nose plates using the anchoring caps. In both systems, the anchoring caps are secured by tightening the threaded washers or nut/washer combinations to clamp the anchoring caps against the nose plate. The anchoring caps are further secured by welding to the nose plates.

Figure 3:
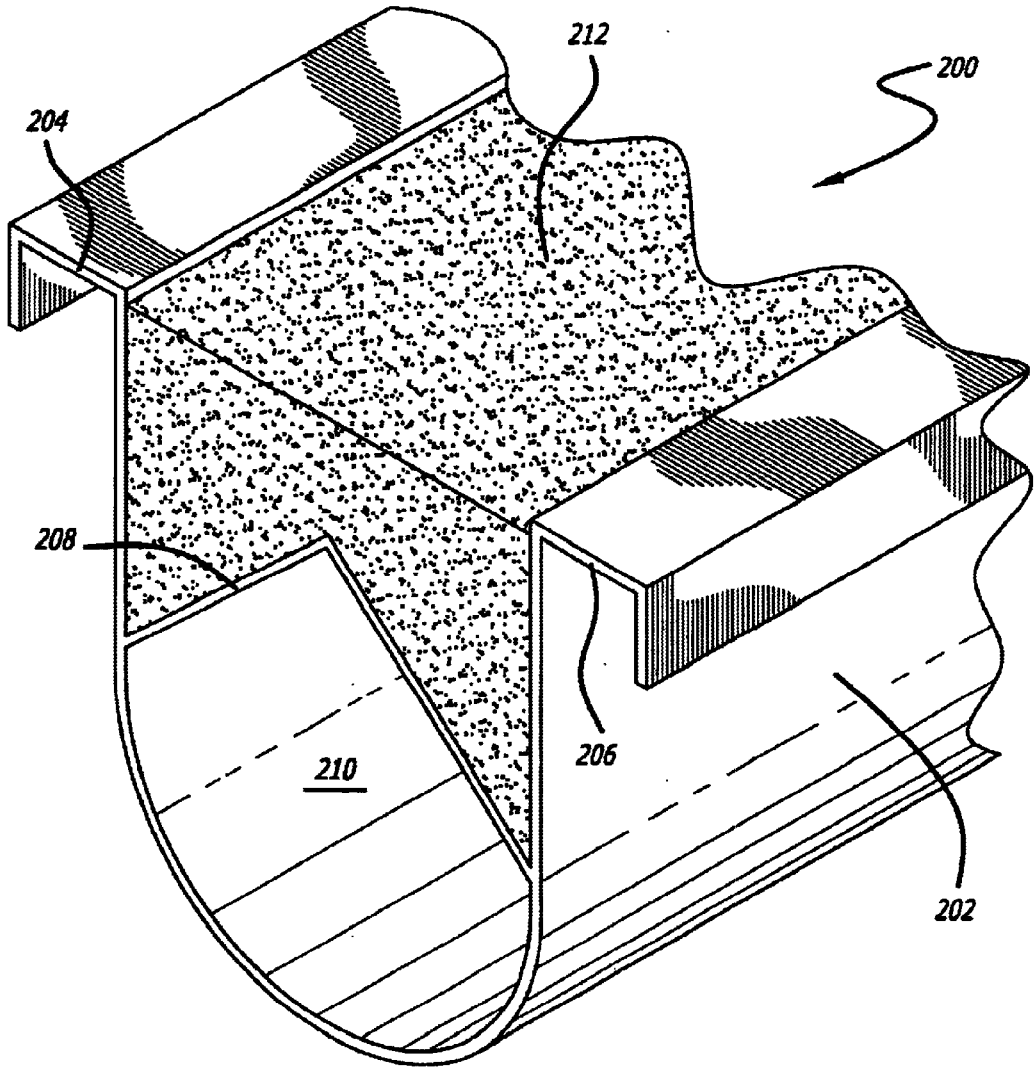
FIG. 3 is a perspective view of a first alternate exemplary preferred combined seal element and vapor barrier configuration for sealing joints that are three inches or less in width.

An alternate preferred sealing configuration is shown at 200 in FIG. 3. The nose plates and anchor caps are not shown for simplicity. The seal 200 is preferably used to seal joints that are less than three inches in width. The seal 200 includes a molded rubber element 202 that has arms or edge portions 204 and 206 that fit snugly over the tops of the nose plates. The walls of the molded rubber element 202 are preferably about ⅛ inch thick. The seal 200 functions both as a lower seal element and a vapor barrier. The seal is generally "U" shaped and includes a transverse wall 208 that is peaked (as shown) or corrugated to allow for expansion of the seal 200. The chamber 210 located below wall 208 is preferably hollow, but may be filled with a flexible foam, if desired. An upper seal 212 is provided using a liquid sealant that is poured into the space above the transverse wall 208 and allowed to cure. If desired, one or more backer rods (not shown) may be combined with the liquid sealant to form the upper seal 212.

Figure 4:
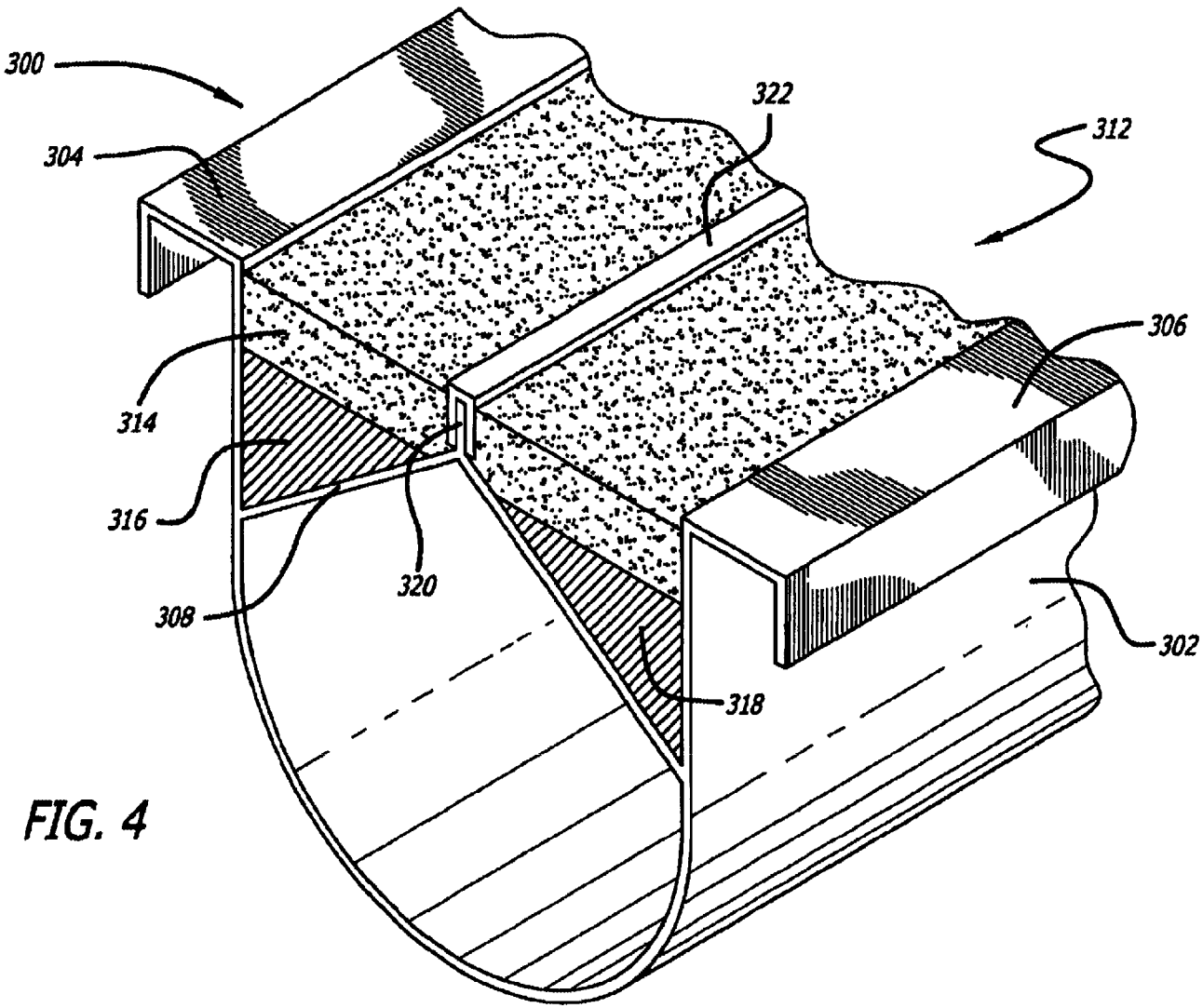
FIG. 4 is a perspective view of a second alternate exemplary preferred combined seal element and vapor barrier configuration for sealing joints that are equal to or larger than three inches in width.

Another alternate preferred sealing configuration is shown at 300 in FIG. 4. Again, the nose plates and anchor caps are not shown for simplicity. The seal 300 is preferably used to seal joints that are equal to or greater than three inches in width. The seal 300 includes a molded rubber element 302 that has arms or edge portions 304 and 306 that fit snugly over the tops of the nose plates. The walls of the molded rubber element 302 are preferably about 3⁄16 inch thick. The seal 300 functions both as a lower seal element and a vapor barrier. The seal is generally "U" shaped and includes a transverse wall 308 that is peaked (as shown) or corrugated to allow for expansion of the seal 300. The chamber 310 located below wall 308 is preferably hollow, but may be filled with foam, if desired. An upper seal shown generally at 312 is formed from a sealant layer 314 that is placed on top of two triangular shaped backer rods 316 and 318. The transverse wall 308 also includes a molded rubber ridge 320 onto which a metal cap 322 is either press fit or molded.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the above preferred embodiments and examples, but is only limited by the following claims.

What is claimed is:

1. A system for sealing a joint in a roadway wherein said joint includes a first wall and a second wall that define a space between said first and second walls that requires sealing, said system comprising:

a first nose plate comprising a top portion, an exterior wall attached to the first wall of said joint and an interior wall;

a second nose plate comprising a top portion, an exterior wall attached to the second wall of said joint and an interior wall, wherein the interior walls of said first and second nose plates define a gap between said interior walls;

a lower seal element located in said gap between the interior walls or said first and second nose plates;

a vapor barrier extending between the top portion of said first nose plate and the top portion of said second nose plate, said vapor barrier comprising a first edge portion attached to the top portion of said first nose plate and a second edge portion attached to the top portion of said second nose plate;

a first anchor cap having an interior surface for anchoring the first edge portion of said vapor barrier to the top portion of said first nose plate by clamping said first edge portion between the interior surface of said first anchor cap and the top portion of said first nose plate; and a second anchor cap having an interior surface for anchoring the second edge portion of said vapor barrier to the top portion of said second nose plate by clamping said second edge portion between the interior surface of said second anchor cap and the top portion of said second nose plate.

2. A system for sealing a joint in a roadway according to claim 1 wherein said lower seal element is a backer rod.

3. A system for sealing a joint in a roadway according to claim 2 wherein said backer rod is an open cell backer rod.

4. A system for sealing a joint in a roadway according to claim 1 wherein said lower seal element includes a top side and a bottom side and wherein said vapor barrier extends around the bottom side of said lower seal element.

5. A system for sealing a joint in a roadway according to claim 4 wherein said vapor barrier is wrapped completely surrounds said lower seal element.

6. A system for sealing a joint in a roadway according to claim 1 that further comprises an upper seal located above said lower seal element wherein said upper seal extends between the top portions of said first and second nose plates.

7. A system for sealing a joint in a roadway according to claim 6 wherein said upper seal comprises a sealant extending between said first and second anchor caps.

8. A system for sealing a joint in a roadway according to claim 6 wherein said upper seal comprises a gasket extending between the top portions of said first and second nose plates and wherein said gasket comprises a first edge portion that is anchored to said first nose plate by said first anchor cap and a second edge portion that is anchored to said second nose plate by said second anchor cap.

9. A system for sealing a joint in a roadway according to claim 1 wherein a first flexible gasket is located between said first anchor cap and said vapor barrier and a second flexible gasket is located between said second anchor cap and said vapor barrier.

10. A system for sealing a joint in a roadway according to claim 9 wherein said first and second flexible gaskets comprise an elastomer.

11. A system for sealing a joint in a roadway according to claim 1 wherein said first and second nose plates comprise a metal.

12. A system for sealing a joint in a roadway according to claim 1 that further comprises a first attachment system for attaching the exterior wall of said first nose plate to the first wall of said joint and a second attachment system for attaching the exterior wall of said second nose plate to the second wall of said joint.

13. A system for sealing joints in a roadway according to claim 1 wherein said roadway is located on a bridge.

14. A method for sealing a joint in a roadway comprising the steps of:

providing a joint wherein said joint includes a first wall and a second wall that define a space between said first and second walls that requires sealing;

attaching a first nose plate to the first wall of said joint, said first nose plate comprising a top portion, an exterior wall that is attached to the first wall of said joint and an interior wall;

attaching a second nose plate to the second wall of said joint, said second nose plate comprising a top portion, an exterior wall that is attached to the second wall of said joint and an interior wall, wherein the interior walls of said first and second nose plates define a gap between said interior walls when said first and second nose plates are attached to the first and second walls of said joint;

installing a lower seal element located in said gap between the interior walls or said first and second nose plates;

providing a vapor barrier extending between the top portion of said first nose plate and the top portion of said second nose plate, said vapor barrier comprising a first edge portion to be attached to the top portion of said first nose plate and a second edge portion to be attached to the top portion of said second nose plate;

anchoring the first edge of said vapor barrier to the top portion of said first nose plate using a first anchor cap having an interior surface for anchoring the first edge portion of said vapor barrier to the top portion of said first nose plate by clamping said first edge portion between the interior surface of said first anchor cap and the top portion of said first nose plate; and anchoring the second edge of said vapor barrier to the top portion of said second nose plate using a second anchor cap having an interior surface for anchoring the second edge portion of said vapor barrier to the top portion of said second nose plate by clamping said second edge portion between the interior surface of said second anchor cap and the top portion of said second nose plate.

15. A method for sealing a joint in a roadway according to claim 14 wherein said lower seal element is a backer rod.

16. A method for sealing a joint in a roadway according to claim 15 wherein said backer rod is an open cell backer rod.

17. A method for sealing a joint in a roadway according to claim 14 wherein said lower seal element includes a top side and a bottom side and wherein said step of providing said vapor barrier comprises extending said vapor barrier around the bottom side of said lower seal element.

18. A method for sealing a joint in a roadway according to claim 17 wherein said step of providing said vapor barrier comprises wrapping said vapor barrier completely around the top and bottom sides of said lower seal element.

19. A method for sealing a joint in a roadway according to claim 14 that further comprises the step of installing an upper seal located above said lower seal element wherein said upper seal extends between the top portions of said first and second nose plates.

20. A method for sealing a joint in a roadway according to claim 19 wherein said step of installing said upper seal comprises applying a sufficient amount of a sealant to said gap to provide a sealant body extending between said first and second anchor caps above said lower seal element.

21. A method for sealing a joint in a roadway according to claim 19 wherein said step of installing said upper seal comprises installing a gasket extending between the top portions of said first and second nose plates, said gasket comprising a first edge portion that is anchored to said first nose plate using said first anchor cap and a second edge portion that is anchored to said second nose plate using said second anchor cap.

22. A method for sealing a joint in a roadway according to claim 14 wherein said first and second nose plates comprise a metal.

23. A method for sealing joints in a roadway according to claim 14 wherein said roadway is located on a bridge.

* * * * *